US007812808B2

(12) United States Patent
Cho et al.

(10) Patent No.: US 7,812,808 B2
(45) Date of Patent: Oct. 12, 2010

(54) LIQUID CRYSTAL DISPLAY

(75) Inventors: Jae-Hyun Cho, Seoul (KR); Cheol-Woo Park, Suwon-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 1030 days.

(21) Appl. No.: 11/541,274

(22) Filed: Sep. 28, 2006

(65) Prior Publication Data

US 2007/0070026 A1 Mar. 29, 2007

(30) Foreign Application Priority Data

Sep. 29, 2005 (KR) ..... 10-2005-0091260

(51) Int. Cl.
*G09G 3/36* (2006.01)

(52) U.S. Cl. ..... 345/102; 345/88

(58) Field of Classification Search ..... 345/87–89, 345/102, 94–96, 204
See application file for complete search history.

(56) References Cited

U.S. PATENT DOCUMENTS

| | | | | |
|---|---|---|---|---|
| 5,402,143 | A * | 3/1995 | Ge et al. | 345/102 |
| 6,392,620 | B1 * | 5/2002 | Mizutani et al. | 345/88 |
| 6,570,554 | B1 * | 5/2003 | Makino et al. | 345/102 |
| 7,199,780 | B2 * | 4/2007 | Sekine | 345/102 |
| 2001/0038371 | A1 * | 11/2001 | Yoshinaga et al. | 345/87 |
| 2003/0137479 | A1 * | 7/2003 | Yamasaki | 345/89 |

FOREIGN PATENT DOCUMENTS

| | | |
|---|---|---|
| JP | 05-080717 | 4/1993 |
| JP | 05-346570 | 12/1993 |
| JP | 10-254390 | 9/1998 |
| JP | 11-295717 | 10/1999 |
| JP | 2000-200063 | 7/2000 |
| JP | 2000-330522 | 11/2000 |
| JP | 2003-233352 | 8/2003 |
| JP | 2005-091875 | 4/2005 |
| JP | 2005-122197 | 5/2005 |

(Continued)

OTHER PUBLICATIONS

English Language Abstract, JP Patent First Publication No. 2005-122197, May 12, 2005, 1 page.

(Continued)

*Primary Examiner*—Regina Liang
(74) *Attorney, Agent, or Firm*—Innovation Counsel LLP

(57) ABSTRACT

The present invention relates to a liquid crystal display. The liquid crystal display includes a liquid crystal panel assembly having a plurality of scanning regions that include a plurality of pixels, respectively; a plurality of light source units that include a plurality of light sources supplying light to the plurality of scanning regions, respectively; a data driver that selects gray voltages corresponding to image signals and applies the selected gray voltages to the plurality of pixels as data signals, respectively; and a light source controller that controls the turning on and off of the light sources. One frame is divided into red, green, blue, and black fields, and the light source controller turns off the light source during the black field. Accordingly, the color mixing phenomenon is reduced, and the lighting time of the light source and the charging time of the pixels increase, thereby improving the image quality.

17 Claims, 4 Drawing Sheets

FOREIGN PATENT DOCUMENTS

| | | |
|---|---|---|
| KR | 2004-61200 | 7/2004 |
| KR | 2004-062211 | 7/2004 |
| KR | 2004-071959 | 8/2004 |
| KR | 2004-086942 | 10/2004 |

OTHER PUBLICATIONS

English Language Abstract, JP Patent First Publication No. 2005-091875, Apr. 7, 2005, 1 page.
English Language Abstract, KR Patent First Publication No. 2004-086942, Oct. 13, 2004, 1 page.
English Language Abstract, KR Patent First Publication No. 2004-071959, Aug. 16, 2004, 1 page.
English Language Abstract, KR Patent First Publication No. 2004-061200, Jul. 7, 2004, 1 page.
English Language Abstract, KR Patent First Publication No. 2004-062211, Jul. 7, 2004, 1 page.
English Language Abstract, JP Patent First Publication No. 2003-233352, Aug. 22, 2003, 1 page.
English Language Abstract, JP Patent First Publication No. 2000-330522, Nov. 30, 2000, 1 page.
English Language Abstract, JP Patent First Publication No. 2000-200063, Jul. 18, 2000, 1 page.
English Language Abstract, JP Patent First Publication No. 11-295717, Oct. 29, 1999, 1 page.
English Language Abstract, JP Patent First Publication No. 10-254390, Sep. 25, 1998, 1 page.
English Language Abstract, JP Patent First Publication No. 05-34657012/27/1993, 1 page.
English Language Abstract, JP Patent First Publication No. 05-080717, Apr. 2, 1993, 1 page.

* cited by examiner

LIQUID CRYSTAL DISPLAY

CROSS-REFERENCE TO RELATED APPLICATION

This application claims priority to and the benefit of Korean Patent Application No. 10-2005-0091260 filed in the Korean Intellectual Property Office on Sep. 29, 2005, the contents of which are incorporated herein by reference.

FIELD OF THE INVENTION

The present invention relates to a liquid crystal display and a method of driving a liquid crystal display.

DESCRIPTION OF THE RELATED ART

Generally, a liquid crystal display (LCD) includes two display panels with a liquid crystal layer exhibiting dielectric anisotropy located between them and having a matrix of pixel electrodes on one panel and a common electrode on the other panel. The pixel electrodes are connected to switching elements, such as thin film transistors (TFTs). The TFT switches data signals to the pixel electrodes for every row. The pixel electrodes, the common electrode together with the liquid crystal layer disposed between them form a matrix of liquid crystal capacitors. In order to display color, each pixel may present the primary colors, for example, red, green and blue, either spatially or sequentially.

In the spatial presentation process, the colors may be presented by mounting color filters of the primary colors in regions corresponding to the pixel electrodes using a white light source, such as a light emitting diode (LED) or a cold cathode fluorescent lamp (CCFL). Light allowed to pass through the liquid crystal layer at a pixel assumes the color provided by the filter.

In a temporal division process, separate sources of the primary colors are provided by light emitting diodes (LEDs) or fluorescent lamps. The temporal division process is conducted such that during one frame, data signals are sequentially applied to all of the pixels to turn on the red light source, then the data signals are applied again to all of the pixels to turn on the green light source, and finally, the data signals are applied again to all of the pixels to turn on the blue light source.

Accordingly, in the case of the temporal division process, one frame is divided into three areas (fields) so as to turn on the red, green, and blue light sources, respectively, and since the light source is turned on after the applying all of the data voltages during each of the fields, there is less time to charge the liquid crystal capacitors so less light passes through the liquid crystal layer at the pixels. While it is desired that the pixels selected in a given frame display a color that is the spatial or temporal sum of the primary colors, the colors actually displayed may be mixed with those of an adjacent field corresponding to a different frame. The color mixing phenomenon affects the liquid crystal display's ability to reproduce colors accurately.

SUMMARY OF THE INVENTION

In accordance with the invention, the pixels of a liquid crystal display are divided into regions for scanning and a plurality of light sources are controlled in accordance with the region being scanned. A data driver selects gray voltages corresponding to image signals and applies the selected gray voltages to the plurality of pixels. A frame memory separates the image signals for a frame on the basis of each of the primary colors and stores the image signals in the frame memory.

Each frame is divided into a plurality of fields, and the light source controller turns off the light source for a field adjacent to the scanned field belonging to a different frame. Preferably, the signal controller reads the image signals corresponding to one of the plurality of primary colors from the frame memory during each of the fields, applies the image signals to the data driver, and does not apply the image signals to the data driver during a field adjacent to the different frame in the plurality of fields.

Another embodiment of the present invention provides a method of driving a liquid crystal display. The liquid crystal display has a plurality of scanning regions that include a plurality of pixels, respectively. In the liquid crystal device, one frame is divided into a plurality of fields. The method includes: applying data signals to the plurality of scanning regions during a plurality of second fields, except for a first field adjacent to a different frame in the plurality of fields; supplying light to the scanning regions, whenever an operation of applying the data signals to each of the scanning regions is finished, and stopping the applying of the data signal and the supplying of light to the plurality of scanning regions during the first field Preferably, the light supplied during the second field is monochromatic light.

Preferably, colors of light supplied during the second field are different from one another, and each of the colors is one of red, green, and blue.

BRIEF DESCRIPTION OF THE DRAWING

The foregoing and other objects and features of the present invention may become more apparent from a reading of the ensuing description together with the drawing, in which.

DETAILED DESCRIPTION

Figure 1:
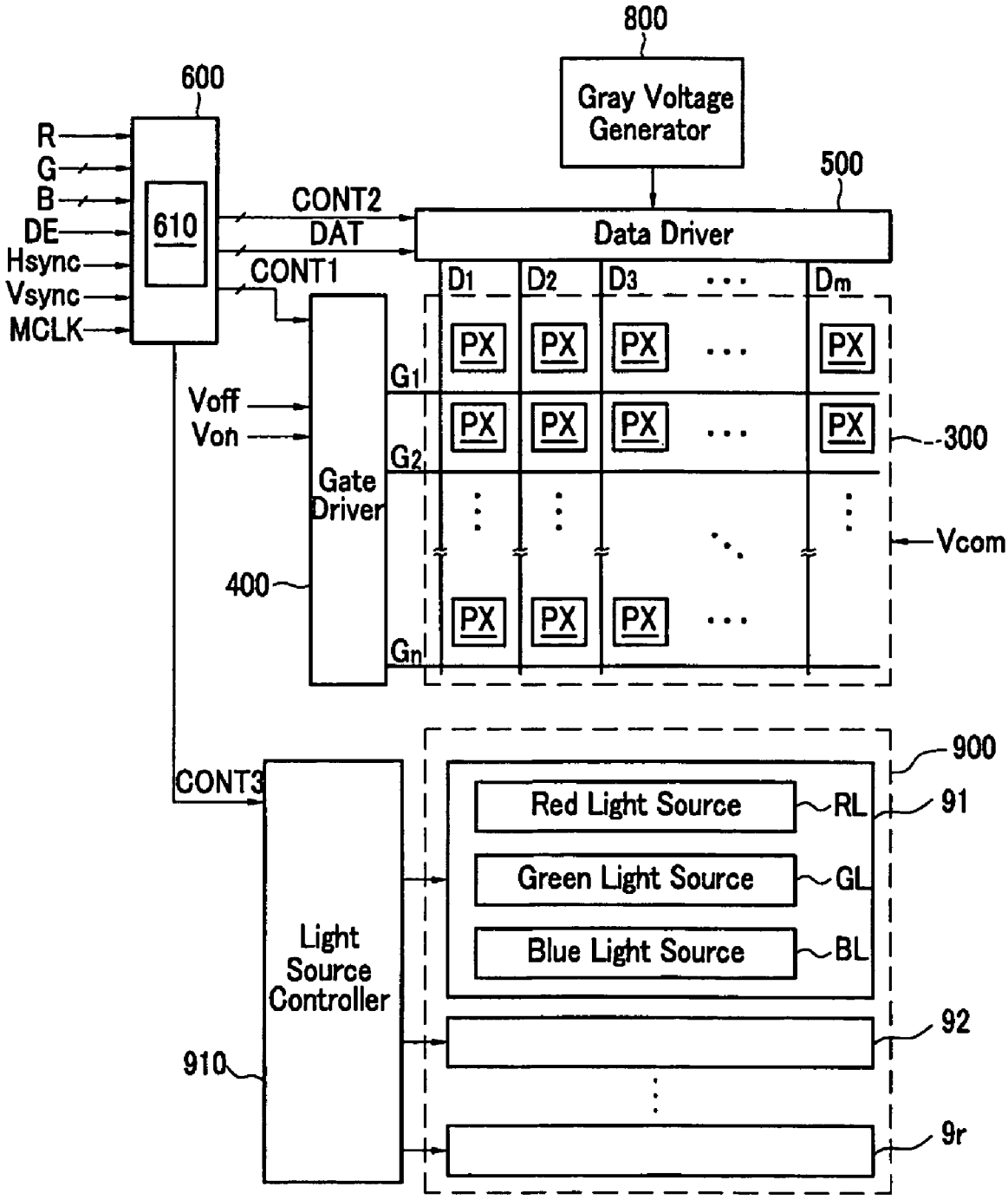
FIG. 1 is a block diagram of a liquid crystal display according to an exemplary embodiment of the present invention.

In the drawing, each layer, film, panel, or region has been adjusted to have a recognizable thickness for ease of understanding. Like parts throughout the specification are represented by like reference numerals. It will be understood that when an element such as a layer, film, region, or substrate is referred to as being "on" another element, it can be directly on the other element or intervening elements may also be present. In contrast, when an element is referred to as being "directly on" another element, there are no intervening elements present.

Figure 2:
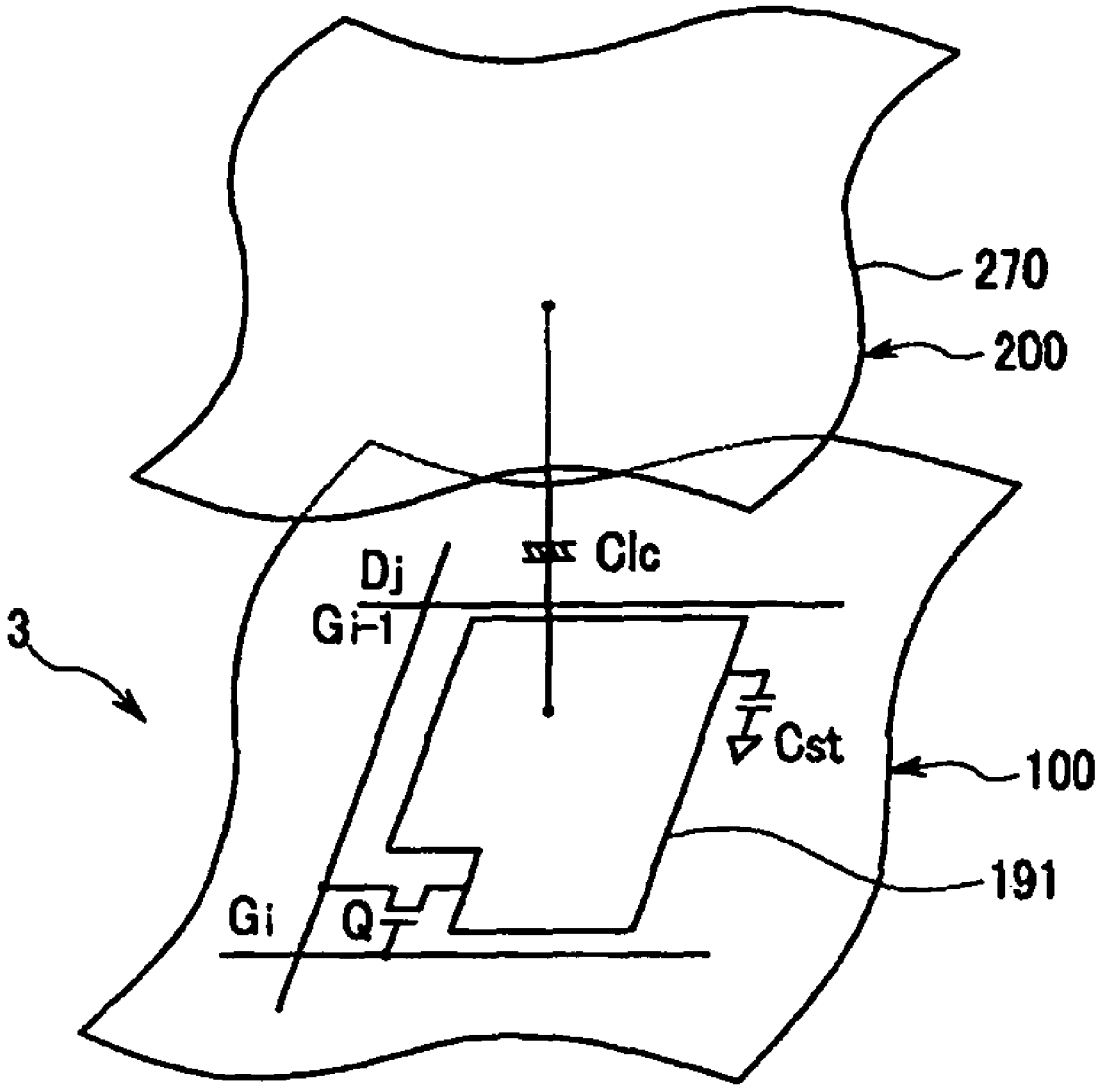
FIG. 2 is an equivalent circuit diagram of a pixel of the liquid crystal display of FIG. 1.
Figure 3:
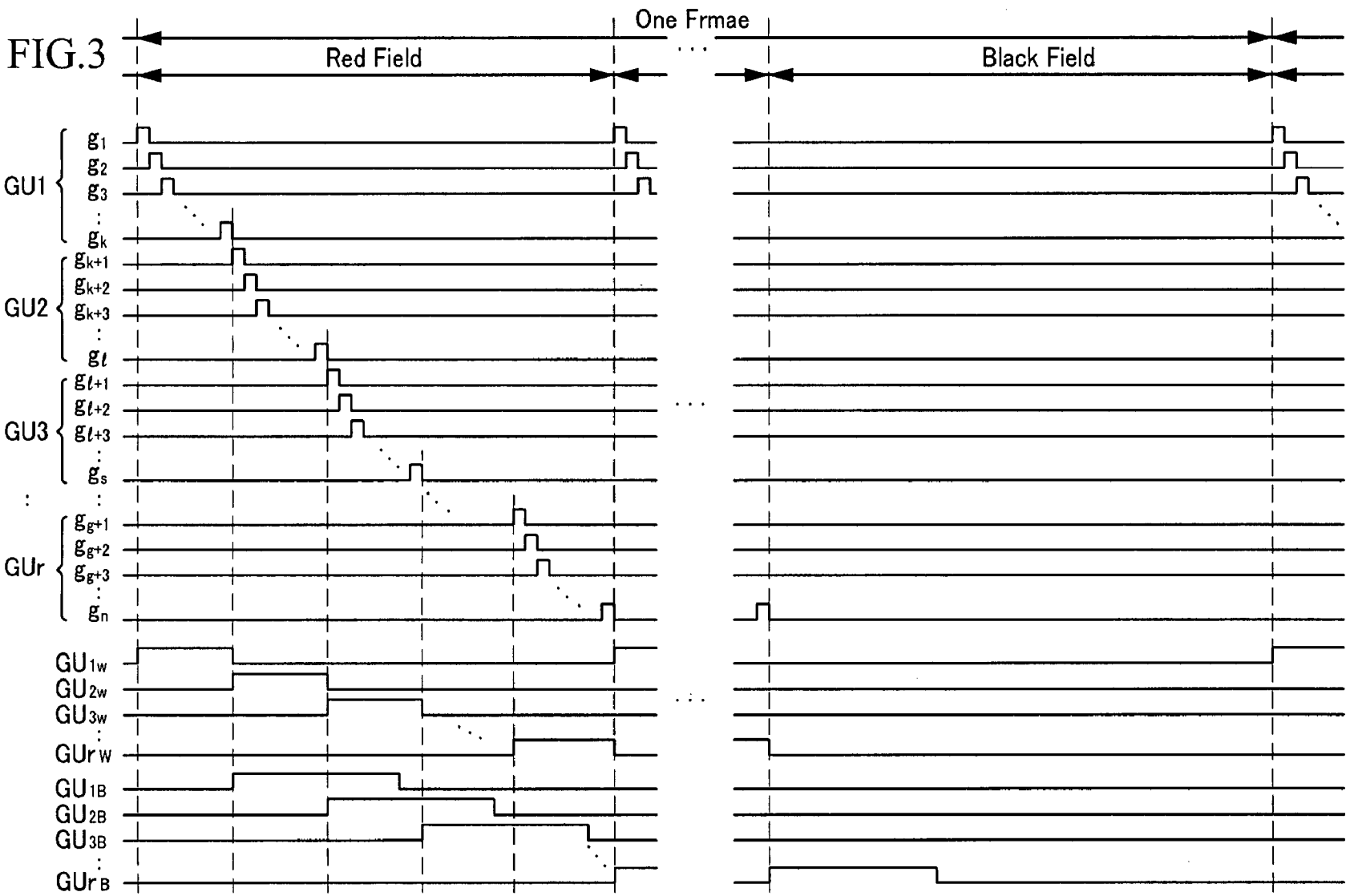
FIG. 3 is a waveform diagram showing the times when the gate-on voltages are applied during each color field of a frame.

FIG. 1 is a block diagram of a liquid crystal display according to an exemplary embodiment of the present invention, and FIG. 2 is an equivalent circuit diagram of a pixel of the liquid crystal display according to an exemplary embodiment of the present invention. FIG. 3 is a waveform diagram showing an applying area of which a gate signal, a light source control signal, and a gate-on voltage are applied to a liquid crystal display according to an exemplary embodiment of the present invention.

As shown in FIG. 1, the liquid crystal display according to the exemplary embodiment of the present invention includes a liquid crystal panel assembly 300, a gate driver 400 and a data driver 500 that are connected to the liquid crystal panel assembly 300, a gray voltage generator 800 that is connected to the data driver 500, a backlight unit 900 that supplies light to the liquid crystal panel assembly 300, a light source controller 910 that is connected to the backlight unit 900, and a signal controller 600 that controls the above-described elements.

As can be seen from an equivalent circuit, the liquid crystal panel assembly 300 includes a plurality of signal lines $G_1$ to $G_n$ and $D_1$ to $D_m$ and a plurality of pixels PX connected to the plurality of signal lines $G_1$ to $G_n$ and $D_1$ to $D_m$ and arranged substantially in a matrix. As shown in FIG. 2, the liquid crystal panel assembly 300 includes a lower panel 100 and an upper panel 200 facing each other, and a liquid crystal layer 3 between the lower panel 100 and the upper panel 200.

The signal lines $G_1$ to $G_n$ and $D_1$ to $D_m$ include a plurality of gate lines $G_1$ to $G_n$ through which gate signals (referred as "scanning signals") are transmitted and a plurality of data lines $D_1$ to $D_m$ through which data signals are transmitted. The gate lines $G_1$ to $G_n$ extend substantially in a row direction so as to be substantially parallel to each other, and the data lines $D_1$ to $D_m$ extend substantially in a column direction so as to be substantially parallel to each other.

Each pixel PX, for example, a pixel PX connected to the i-th gate line $G_i$ (where i=1, 2, . . . , and n) and the j-th data line $D_j$ (where j=1, 2, . . . , and m) includes a switching element Q that is connected to the signal lines $G_i$ and $D_j$, a liquid crystal capacitor Clc, and a storage capacitor Cst that are connected to the switching element Q. The storage capacitor Cst may be omitted, if necessary.

The switching element Q is a three-terminal element, such as a thin film transistor that is provided on the lower panel 100, and it includes a control terminal connected to the gate line $G_i$, an input terminal connected to the data line $D_j$, and an output terminal connected to the liquid crystal capacitor Clc and the storage capacitor Cst.

The liquid crystal capacitor Clc includes a pixel electrode 191 on lower panel 100, a common electrode 270 on upper panel 200, and liquid crystal layer 3 between the two electrodes that serves as a dielectric. Pixel electrode 191 is connected to switching element Q, and the common electrode 270 is formed on an entire surface of the upper panel 200 such that a common voltage Vcom is applied to the common electrode. Alternatively, the common electrode 270 may, unlike FIG. 2, be arranged on the lower panel 100. In this case, at least one of the pixel electrode 191 and the common electrode 270 may have a linear or bar shape.

The storage capacitor Cst is an auxiliary capacitor for the liquid crystal capacitor Clc. The storage capacitor Cst has a structure in which an additional signal line (not shown) and the pixel electrode 191 arranged on the lower panel 100 overlap with an insulator therebetween, and a predetermined voltage, such as the common voltage Vcom, is applied to the additional signal line. However, the storage capacitor Cst may have a structure in which the pixel electrode 191 overlaps the above-described gate line right above the pixel electrode 191 with the insulator therebetween.

At least one polarizer (not shown) that polarizes light is attached to the outer surface of the liquid crystal panel assembly 300.

Referring again to FIG. 1, gray voltage generator 800 generates two sets of gray voltages (or two reference gray voltages) related to the transmittance of the pixel PX. One of the two sets of gray voltages has a positive value with respect to the common voltage Vcom, and the other has a negative value with respect to the common voltage Vcom.

Gate driver 400 is connected to the gate lines $G_1$ to $G_n$ of the liquid crystal panel assembly 300, and applies the gate signals having a combination of a gate-on voltage Von and a gate-off voltage Voff to the gate lines $G_1$ to Gn.

Data driver 500 is connected to data lines $D_1$ to $D_m$ of the liquid crystal panel assembly 300, selects the gray voltages generated by the gray voltage generator 800, and applies the selected gray voltages to data lines $D_1$ to $D_m$ as the data signals. However, when the gray voltage generator 800 generates only a predetermined number of the reference gray voltages without generating all the gray voltages for all the grays, the data driver 500 divides the reference gray voltages to generate the gray voltages for all the grays and selects the data signals therefrom.

Backlight unit 900 includes r light source units 91 to **9*r*. Each of the r light source units 91 to 9*r* is disposed on the lateral side or a rear side of the liquid crystal panel assembly 300**, and includes a red light source RL, a green light source GL, and a blue light source BL. At this time, the respective light sources RL, GL, and BL include at least one lamp, and the lamp may be a red, green, or blue light emitting diode (LED).

Each of the light source units 91 to **9*r* supplies light to a corresponding scanning region of the liquid crystal panel assembly 300 that is virtually divided into r sections in a vertical direction. As shown in FIG. 3, each of scanning regions (hereinafter, referred as "display panel sub-regions") may be virtually divided by each of gate line groups GU1-GUr each having the same number of gate lines $G_1$ to $G_n$, and the divided number of the scanning regions is equal to the number of the light source units 91 to 9*r*. Accordingly, from the top of the liquid crystal panel assembly 300, the first light source unit 91 emits the light to the first display panel sub-region, the second light source unit 92 emits the light to the second display panel sub-region, and the r-th light source unit 9*r* emits the light to the last display panel sub-region. It is preferable that each of the display panel sub-regions have the same size. In addition, the interfaces of the display panel sub-regions are formed in the length direction of the gate lines $G_1$ to $G_n$ of the liquid crystal panel assembly 300, and partitions extending along the interfaces are provided between the interfaces so as to prevent the light of the respective display panel sub-regions emitted from the light source units 91 to 9*r*** from entering the adjacent regions. Furthermore, the partitions may be coated by aluminum so as to favorably reflect.

Light source controller 910 outputs the light source control signals for controlling the turning on and off of the respective light source units 91 to **9*r*. Signal controller 600 includes a frame memory 610 for storing the input image signals and controls gate driver 400, data driver 500, and light source controller 910**.

Each of the driving devices 400, 500, 600, 800, and 910 may be directly mounted on the liquid crystal panel assembly 300 or a flexible printed circuit film (not shown) in the form of at least one IC chip, and may be attached to the liquid crystal panel assembly 300 in a TCP (tape carrier package) type or mounted on a separate printed circuit board (PCB) (not shown). Alternately, these driving devices 400, 500, 600, 800, and 910 may be integrated into the liquid display panel assembly 300 together with the signal lines $G_1$ to $G_n$ and $D_1$ to $D_m$ and the thin film transistor switching elements Q. In addition, the driving devices 400, 500, 600, 800, and 910 may be integrated into a single chip. In this case, at least one of the driving devices 400, 500, 600, 800, and 910 or at least one circuit element in the driving devices 400, 500, 600, 800, and 910 may be provided outside the single chip.

Signal controller 600 receives input image signals R, G, and B and input control signals for controlling the display thereof from an external graphics controller (not shown). The input control signals include, for example, a vertical synchronization signal Vsync, a horizontal synchronizing signal Hsync, a main clock signal MCLK, and a data enable signal DE.

On the basis of the input image signals R, G, and B and the input control signals, signal controller 600 appropriately processes the input image signals R, G, and B to generate a gate control signal CONT1, a data control signal CONT2, and a light source control signal CONT3. Signal controller 600 separates the input image signals for a frame into a red image signal R, a green image signal G, and a blue image signal B, and stores the red image signal R, the green image signal G, and the blue image signal B into corresponding regions of frame memory 610.

Gate control signal CONT1 includes a scanning start signal STV and at least one clock signal for controlling the output period of the gate-on voltage Von. The gate control signal CONT1 may further include an output enable signal OE for defining the duration time of the gate-on voltage Von.

Data control signal CONT2 includes a horizontal synchronization start signal STH for each row of pixels PX, a load signal LOAD for applying the data signals to the data lines $D_1$ to $D_m$, and a data clock signal HCLK.

Data control signal CONT2 may further include an inversion signal RVS for reversing the polarity of the voltage of the data signals with respect to the common voltage Vcom (hereinafter, "the polarity of the voltage of the data signals with respect to the common voltage" is simply referred as "the polarity of the data signals").

Light source control signal CONT3 includes the red, green, and blue light source control signals for turning on or off the red, green, and blue light sources RL, GL, and BL on the basis of the gate signals.

In accordance with the data control signal CONT2, data driver 500 receives digital image signals DAT with respect to one row of pixels PX during the red field, the green field, and the blue field included within the one frame, converts the digital image signals DAT into analog data signals by selecting the gray voltages corresponding to the respective digital image signals DAT, and applies the converted analog data signals to the data lines $D_1$ to $D_m$.

During the red, green, and blue fields, the red, green, and blue digital image signals DAT that are respectively stored in the corresponding regions of the frame memory 610 are applied to the data driver 500, but during the black field, an additional image signal DAT is not applied to the data driver 500. As such, one frame is divided into four fields, for example, the red, green, blue, and black fields, and all of the fields have the same period, but they may have a different period. Alternatively, a portion of the fields may have a different period.

Gate driver 400 applies the gate-on voltage Von to the gate lines $G_1$ to $G_n$ in accordance with the gate control signal CONT1 from signal controller 600, thereby turning on the switching elements Q connected to the gate lines $G_1$ to $G_n$.

Then, the data signals applied to the data lines $D_1$ to $D_m$ are supplied to the corresponding pixels PX through the switching elements Q having been turned on.

The difference between the voltage of the data signal and the common voltage Vcom applied to the pixel PX is represented as a charging voltage of the liquid crystal capacitor Clc, which is referred to as a pixel voltage. Liquid crystal molecules have different arrangements in accordance with the magnitude of the pixel voltage, so that the polarization of light passing through the liquid crystal layer 3 varies. The variation of the polarization is caused by the transmittance variation of light by a polarizer attached to the liquid crystal display panel assembly 300.

By repeating the above-mentioned processes while using one horizontal period (referred as "1H" and equal to one period of the horizontal synchronizing signal Hsync and the data enable signal DE) as a unit, the gate-on voltage Von is sequentially applied to all the gate lines $G_1$ to $G_n$, while the data signals are applied. During the respective fields, if the data signals are applied to all the pixels, the light source controller 910 turns on the red, green, or blue light source RL, GL, or BL of the light source units 91 to **9*r* for the display panel sub-regions corresponding to the gate line groups GU1 to GUr gate signal on the basis of the light source control signal CONT3, whenever a scanning operation of the gate signals applied to the respective gate lines $G_1$ to $G_n$ is finished for each unit of the gate line groups GU1** to GUr.

During each field, the image for one frame is displayed by sequentially supplying the red, green, or blue light to a plurality of the display panel sub-regions. In this case, during the black field serving as a final field, the light source units 91 to **9*r* do not operate. The operation of the above-described light source controller 910 and the backlight unit 900** will be described in detail below.

When the next frame starts after one frame is finished, an inversion signal RVS applied to the data driver 500 is controlled such that the polarity of the data signals applied to the respective pixels PX is reversed with respect to the polarity of the previous frame ("frame inversion"). At this time, according to the characteristic of the inversion signal RVS during one frame, the polarities of the data signals flowing through the data line may be reversed (for example, row inversion and dot inversion) or the polarities of the data signals applied to one pixel row may be reversed (for example, column inversion and dot inversion).

Figure 4:
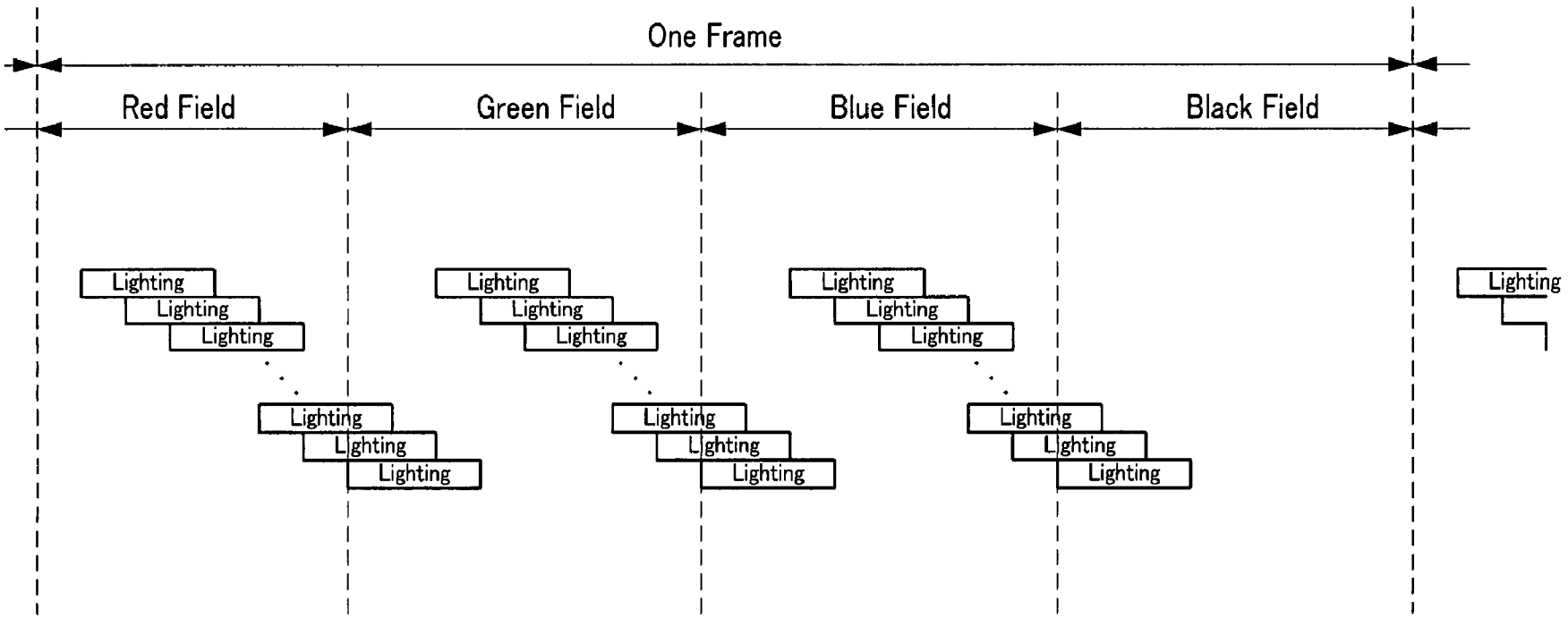
FIG. 4 is a view showing the on/off times of the backlight unit during one frame.

Next, the operation of the light source controller 910 and the backlight unit 900 will be described in detail with reference to FIGS. 3 and 4. FIG. 4 is a view showing the operation state of the backlight unit during one frame of the liquid crystal display according to an exemplary embodiment of the present invention.

For convenience of description, the liquid crystal panel assembly 300 is virtually divided into the display panel sub-regions. The uppermost of the sub-regions is referred as the first sub-region, and the lowermost is referred as the r-th display panel sub-region. The light source units 91 to **9*r* corresponding to the display panel sub-regions are referred as the first light source unit 91 to the r-th light source unit 9*r***. In addition, one frame is sequentially divided into the red, green, blue, and black fields to which the same time is allocated, respectively. The red data signal is applied during the red field, the green data signal is applied during the green field, and the blue data signal is applied during the blue field, respectively. However, the field order may be changed and, in this case, the applying the data signals should be also changed.

The operation of the light source controller 910 and the backlight unit 900 during the red field of one frame will be described on the basis of the operation of gate driver 400. As shown in FIG. 3, during each color field of a frame, gate driver 400 sequentially outputs a gate-on voltage Von as gate signals $g_1$ to $g_k$ having a predetermined pulse width to the k gate lines of each of gate line groups GU1 to GUr. The pulse width of the gate-on voltage Von is determined by an output enable signal OE (not shown). The data signals sequentially charge to the pixels associated with each sequentially scanned gate line groups.

For example, after gate-on voltage Von is applied to gate lines $G_1$ to $G_k$ of the first gate line group GU1, the light source controller 910 outputs a lighting pulse for the red light source RL. Light source control signal $GU_{1B}$ is applied to the first light source unit 91 of backlight unit 900 in synchronization with the falling edge of the gate-on voltage Von applied to the kth gate line of group GU1. When the lighting pulse is applied, the red light source RL turns on and supplies red light to the first display panel sub-region. The green light source GL and the blue light source BL are in the turned-off state.

Next, gate driver 400 sequentially outputs gate-on voltage Von to gate signals $g_{k+1}$ to $g_1$ for the second gate line group GU2. The light source control signal $GU_{2B}$ is applied to the second light source unit 92 of backlight unit 900 in synchronization with the falling edge of the gate-on voltage Von applied to the kth gate line of group GU2. As a result, the red light source RL of the second light source unit 92 is turned on when the lighting pulse is applied and supplies the red light to the second display panel sub-region, while the green light source and the blue light source GL and BL maintain their turned-off state. In this case, since the green light source RL of the first light source unit 91 also maintains the turned-on state, the turned-on areas of the light source units 91 and 92 partially overlap.

If the gate-on voltage Von is applied up to the gate signal $g_n$ which is applied to the final gate line $G_n$ of the final gate line group GUr in the above-described manner, the light source controller 910 outputs the lighting pulse of the red light source to the light source control signal $GU_{rB}$ applied to the final light source unit 9*r*, and sequentially supplies the red light up to the final display panel sub-region during the red field.

In this way, after the scanning operation of the gate lines corresponding to the respective gate line groups GU1 to GUr is finished during one field, the light source units 91 to 9*r* operate and sequentially supply light of the corresponding colors to the display panel sub-regions.

Next, in the green field, gate driver 400 sequentially applies the gate-on voltage Von from the first gate line group GU1 to the final gate line group GUr, similar to the operation in the red field. After the gate-on voltage Von is applied to the respective gate line groups GU1 to GUr, the light source controller 910 outputs the lighting pulse to the light source control signals $GU_{1B}$ to $GU_{rB}$ applied to the corresponding light source units 91 to 9*r*, and sequentially supplies light to the corresponding display panel sub-region.

However, in the green field, the data signals applied to the respective pixels correspond to the green data signals stored in the frame memory 610 of signal controller 600. Accordingly, only the green light sources GL of the respective light source units 91 to 9*r* are turned on, and the other light sources, for example, the red and blue light sources RL and BL, are turned off.

Similarly, in the blue field, the gate-on voltage Von is sequentially applied from the first gate line group GU1 to the final gate line group GUr by gate driver 400. The light source controller 910 outputs the lighting pulse to the light source control signals $GU_{1B}$ to $GU_{rB}$ applied to the corresponding light source units 91 to 9*r* in synchronization with a falling edge of the gate-on voltage Von applied to the final gate lines $G_k$, $G_1$, $G_s$, . . . , and $G_n$ of the gate line group GUr, and sequentially supplies light to the corresponding display panel sub-regions. At this time, the data signals applied to the respective pixels correspond to the blue data signals stored in the frame memory 610 of signal controller 600. Accordingly, only the blue light sources BL of the respective light source units 91 to 9*r* are turned on, and the other light sources, for example, the red and green light sources RL and GL, are turned off.

However, during the black field serving as a fourth field, gate driver 400 does not output the gate-on voltage Von to all of the gate lines $G_1$ to $G_n$, and the light source controller 910 does not output the lighting pulse to the light source control signals $GU_{1B}$ to $GU_{rB}$ of the light source units 91 to 9*r* corresponding to the respective gate line groups GU1 to GUr. Accordingly, the backlight unit 900 maintains the turned-off state. The light source units 91 to 9*r*, which are turned on during the blue field right before the black field, maintain the turned-on state until the black field.

As shown in FIG. 4, during the respective fields within one frame, the red, green, and blue light sources are sequentially turned on for every display panel sub-region by the operation of the above-described backlight unit 900, and then maintain the turned-off state during the final black field.

In FIG. 3, reference numerals $GU_{1W}$, $GU_{2W}$, $GU_{3W}$, . . . , and $GU_{rW}$ are waveforms showing the applying areas of the gate-on voltage for the respective gate line groups GU1 to GUr.

As described above, according to the present invention, the red, green, and blue light sources RL, GL, and BL of the light source units 91 to 9*r* are sequentially driven for every display panel sub-region, in the red, green, and blue fields, and the light source units 91 to 9*r* are turned off in the black field.

As described above, according to the present invention, in addition to the red, green, and blue fields in which the red, green, and blue light sources are turned on during one frame, the black field in which the light source unit is turned off exists. As a result, the color mixing phenomenon is prevented, and the color reproducibility is improved. Accordingly, the image quality of the display device is improved.

In addition, the light source units corresponding to the respective display panel sub-regions that are virtually divided are sequentially turned on during the respective fields within one frame, and output the red, green, or blue light. As a result, the lighting times of the light source units increase, and the lighting times of the light source units further increase because the lighting times of the light source units adjacent to each other partially overlap. Accordingly, the resolution of the image quality increases, and the image quality of the display device is improved.

Further, since the turning-on of the light source operates together with the applying of the data signal, the charging time of the liquid crystal capacitor increases, and the image quality is improved.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A liquid crystal display, comprising:

a liquid crystal panel assembly having a plurality of scanning regions that each include a plurality of pixels;

a plurality of light source units supplying light to the plurality of scanning regions, respectively;

a data driver that selects gray voltages for a frame of image signals and applies the selected gray voltages to the plurality of pixels as data signals; and a light source controller that controls the turning on and off of light sources of the light source units, a signal controller dividing a frame into a plurality of fields, the light source controller turning off the light sources during a field adjacent to a different frame in the plurality of fields, wherein the light source units supply light to the scanning regions whenever an operation of applying the selected gray voltages to the scanning regions is finished, and during a time when a light source unit supplies light to a corresponding scanning region, at least one scanning region different from said corresponding scanning region is applied with data signals.

2. The liquid crystal display of claim 1, wherein each of the fields has the same time.

3. The liquid crystal display of claim 1, wherein each of the light source units includes at least three light sources which emit a plurality of primary colors, respectively.

4. The liquid crystal display of claim 3, wherein colors of light supplied during the respective fields are different from one another.

5. The liquid crystal display of claim 3, wherein each of the light sources is a light emitting diode (LED).

6. The liquid crystal display of claim 3, wherein the primary colors are red, green, and blue.

7. The liquid crystal display of claim 1, further comprising a signal controller that applies the image signals to the data driver and controls the operation of the light source controller and the data driver.

8. The liquid crystal display of claim 7, wherein:

the image signals include image signals corresponding to the plurality of primary colors, respectively; and the signal controller includes a frame memory storing the image signals of one frame, and separates the image signals inputted during one frame on the basis of the primary colors and stores the image signals in the frame memory.

9. The liquid crystal display of claim 8, wherein the signal controller reads the image signals corresponding to one of the plurality of primary colors from the frame memory during each of the fields, applies the image signals to the data driver, and does not apply the image signals to the data driver during a field adjacent to the different frame in the plurality of fields.

10. The liquid crystal display of claim 1, wherein the field that is adjacent to the different frame in the plurality of fields is a final field.

11. A method of driving a liquid crystal device having a plurality of scanning regions that include a plurality of pixels, respectively, one frame being divided into a plurality of fields in the liquid crystal device, the method comprising:

applying data signals to the plurality of scanning regions during a plurality of second fields, except for a first field adjacent to a different frame in the plurality of fields;

supplying light to the scanning regions, whenever an operation of applying the data signals to each of the scanning regions is finished; and stopping the applying of the data signal and the supplying of light to the plurality of scanning regions during the first field,.

wherein during a time when a scanning region is supplied with light, at least one scanning region different from said scanning region supplied with light is applied with data signals.

12. The method of driving a liquid crystal display of claim 11, wherein the light supplied during the second field is monochromatic light.

13. The method of driving a liquid crystal display of claim 12, wherein colors of light supplied during the second field are different from one another, and each of the colors are one of red, green, and blue.

14. The method of driving a liquid crystal display of claim 11, wherein supplying periods of light supplied to adjacent scanning regions partially overlap.

15. A liquid crystal display having a plurality of pixels, comprising:

groups of light sources supplying light to corresponding groups of pixel regions of said display;

means applying gray voltages representing data signals to the display;

a signal controller dividing a frame of data signals into a sequence of fields, the controller sequentially gating on a group of pixel regions to be charged by said gray voltages during a first portion of each of said fields and gating on a corresponding one of the groups of light sources after the group of pixel regions has been charged, wherein during a time a group of light sources corresponding to a group of pixels is gated on, at least one group of pixels different from said corresponding group of pixels is gated on to be charged with gray voltages.

16. The liquid crystal display according to claim 15 wherein the sequence of fields includes a set of primary color fields for each frame of data signals.

17. The liquid crystal display according to claim 16 wherein the sequence of fields in each frame includes a black field in which all of the light sources are turned off.

* * * * *